US009249547B2

(12) United States Patent
Du Maire et al.

(10) Patent No.: US 9,249,547 B2
(45) Date of Patent: Feb. 2, 2016

(54) SWEEPING VEHICLE

(71) Applicant: Alfred Kärcher GmbH & Co. KG, Winnenden (DE)

(72) Inventors: Bastian Du Maire, Reutlingen (DE); Dietmar Kull, Winnenden (DE); Uwe Weller, Allmersbach im Tal (DE); Martin Sickinger, Stuttgart (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 210 days.

(21) Appl. No.: 14/107,351

(22) Filed: Dec. 16, 2013

(65) Prior Publication Data

US 2014/0101874 A1 Apr. 17, 2014

Related U.S. Application Data

(63) Continuation of application No. PCT/EP2011/060121, filed on Jun. 17, 2011.

(51) Int. Cl.
*A47L 11/40* (2006.01)
*E01H 1/05* (2006.01)

(52) U.S. Cl.
CPC ..... *E01H 1/053* (2013.01); *A47L 11/4052* (2013.01)

(58) Field of Classification Search
CPC ..... E01H 1/053; A47L 11/4052
See application file for complete search history.

(56) References Cited

U.S. PATENT DOCUMENTS

| | | | | |
|---|---|---|---|---|
| 3,790,981 | A * | 2/1974 | Young | E01H 1/053 15/340.3 |
| 4,335,482 | A | 6/1982 | Jones | |
| 4,368,554 | A * | 1/1983 | Mealing | E01H 1/047 15/340.3 |
| 4,691,402 | A * | 9/1987 | Veselka | E01H 1/053 15/87 |
| 4,754,521 | A | 7/1988 | Zoni | |
| 5,015,300 | A | 5/1991 | Leers | |
| 2008/0201878 | A1 | 8/2008 | Katenhusen et al. | |

FOREIGN PATENT DOCUMENTS

| | | |
|---|---|---|
| CN | 1889882 | 1/2007 |
| CN | 101070696 | 11/2007 |
| CN | 101324059 | 12/2008 |
| CN | 201381493 | 1/2010 |
| DE | 40 01 088 | 7/1991 |
| DE | 43 35 846 | 4/1995 |
| EP | 1 424 448 | 6/2004 |
| EP | 1 769 950 | 4/2007 |

(Continued)

*Primary Examiner* — Randall Chin
(74) *Attorney, Agent, or Firm* — Womble Carlyle Sandridge & Rice, LLP

(57) ABSTRACT

A sweeping vehicle is provided including a disc brush and a holding device for the disc brush, the holding device having a holding part and a holding arm pivotably connected to the holding part, the holding device held on the vehicle by the holding part, and the disc brush held on the holding arm. The vehicle includes an adjusting device having an adjustment member of variable length engaging the holding arm, the holding arm being pivotable relative to the holding part upon change in length of the adjustment member. The holding device includes a brush carrier pivotably mounted on the holding arm and a coupling device coupling the brush carrier to the adjusting device, the brush carrier being pivotable relative to the holding arm upon change in length of the adjustment member for pivoting the disc brush about a pivot axis aligned at a slant to the axis of rotation.

22 Claims, 7 Drawing Sheets

(56) References Cited

FOREIGN PATENT DOCUMENTS

| | | |
|---|---|---|
| GB | 830454 | 3/1960 |
| JP | S 51-88871 | 8/1976 |
| JP | S54-19115 | 2/1979 |
| JP | 06-53625 | 7/1994 |
| JP | 09-053216 | 2/1997 |
| JP | 2000-257036 | 9/2000 |

* cited by examiner

SWEEPING VEHICLE

CROSS-REFERENCE TO RELATED APPLICATIONS

The present application is a continuation of international application number PCT/EP2011/060121, filed on Jun. 17, 2011, which is incorporated herein by reference in its entirety and for all purposes.

FIELD OF THE INVENTION

The present invention relates to a sweeping vehicle, comprising a disc brush for sweeping dirt off a ground surface to be cleaned, the disc brush having a brush disc with brushes held thereon and being rotationally drivable about an axis of rotation, and comprising a holding device for holding the disc brush, the holding device having a holding part and a holding arm pivotably connected to the holding part, the holding device being held on the sweeping vehicle by way of the holding part, and the disc brush being held on the holding arm, and comprising an adjusting device having an adjustment member of variable length, which engages the holding arm, the holding arm being pivotable relative to the holding part in dependence upon a change in length of the adjustment member for lowering and lifting the disc brush.

BACKGROUND OF THE INVENTION

In such a sweeping vehicle, the disc brush is held by means of the holding device on the remaining sweeping vehicle. The holding device comprises a holding part which, for example, may be formed by a frame of the sweeping vehicle, but may also be formed separately from the sweeping vehicle or may be secured to the sweeping vehicle, and a holding arm pivotably mounted on the holding part. The disc brush is held directly or indirectly on the holding arm. Under the action of the adjustment member, which can be varied in length, of the adjusting device, the holding arm can be pivoted relative to the holding part and the disc brush thereby lowered onto the ground surface to be cleaned, for example, when the sweeping vehicle is put into operation, and lifted off the ground surface to be cleaned, for example, at the end of operation. The adjustment member engages the holding arm and is, for example, pivotably mounted thereon. The holding part, a frame or another structural part of the sweeping vehicle, for example, acts as counter bearing for the adjustment member.

The brush disc in a sweeping vehicle of the kind mentioned at the outset is usually inclined relative to the horizontal in order that not all brushes of the disc brush will contact the ground surface simultaneously. Instead, the area of contact of the brushes with the ground surface, also referred to as "sweeping pattern" or "working range", has, for example, a kidney-shaped, a crescent-shaped or circular ring segment-shaped configuration owing to the inclination of the brush disc. The purpose of this is to sweep dirt off the ground surface in a defined direction so the dirt can be taken up by a dirt pick-up device of the sweeping vehicle, for example, a roller brush or a suction device, from the ground surface.

EP 1 769 950 A2 describes a generic sweeping vehicle in which a combination of holding device and disc brush can be tilted by an additional adjusting device in such a way that starting from a horizontal position, the brush disc can be inclined to a slanted position with respect to the horizontal and, consequently, the sweeping pattern can be changed from a circular shape to a kidney shape.

In the present case, indications of position, location and direction such as, for example, "at the top", "at the bottom", "horizontal", "vertical" or the like are to be understood in relation to a position of use of the sweeping vehicle in which the sweeping vehicle is positioned on a horizontal ground surface.

An object underlying the present invention is to provide a sweeping vehicle of the kind mentioned at the outset in which the sweeping pattern of the disc brush can be changed in a constructionally simple way.

SUMMARY OF THE INVENTION

In an aspect of the invention, a sweeping vehicle comprises a disc brush for sweeping dirt off a ground surface to be cleaned, the disc brush having a brush disc with brushes held thereon and being rotationally drivable about an axis of rotation. The sweeping vehicle comprises a holding device for holding the disc brush, the holding device having a holding part and a holding arm pivotably connected to the holding part, the holding device being held on the sweeping vehicle by way of the holding part, and the disc brush being held on the holding arm. The sweeping vehicle comprises an adjusting device having an adjustment member of variable length, which engages the holding arm, the holding arm being pivotable relative to the holding part in dependence upon a change in length of the adjustment member for lowering and lifting the disc brush. The holding device comprises a brush carrier which is pivotably mounted on the holding arm and on which the disc brush is held. The sweeping vehicle comprises a coupling device for coupling the brush carrier to the adjusting device, the brush carrier being pivotable relative to the holding arm in dependence upon a change in length of the adjustment member for pivoting the disc brush about a pivot axis aligned at a slant to the axis of rotation.

BRIEF DESCRIPTION OF THE DRAWING FIGURES

The foregoing summary and the following description may be better understood in conjunction with the drawing figures, of which:

DETAILED DESCRIPTION OF PREFERRED EMBODIMENTS OF THE INVENTION

Figure 1:
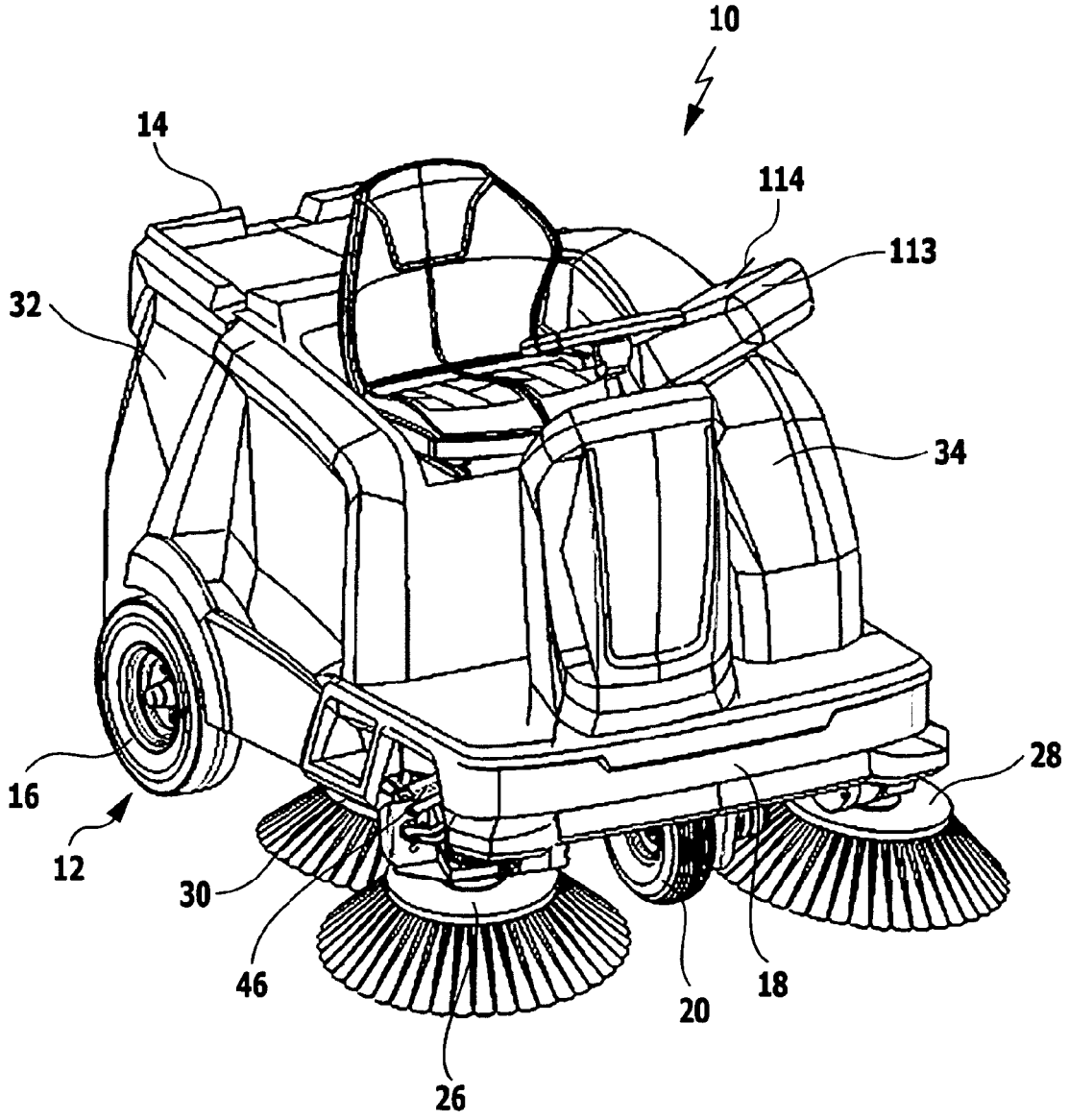
FIG. 1 shows a perspective representation of a sweeping vehicle in accordance with the invention.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a sweeping vehicle, comprising a disc brush for sweeping dirt off a ground surface to be cleaned, the disc brush having a brush disc with brushes held thereon and being rotationally drivable about an axis of rotation, and comprising a holding device for holding the disc brush, the holding device having a holding part and a holding arm pivotably connected to the holding part, the holding device being held on the sweeping vehicle by way of the holding part, and the disc brush being held on the holding arm, and comprising an adjusting device having an adjustment member of variable length, which engages the holding arm, the holding arm being pivotable relative to the holding part in dependence upon a change in length of the adjustment member for lowering and lifting the disc brush. The holding device comprises a brush carrier which is pivotably mounted on the holding arm and on which the disc brush is held. The sweeping vehicle comprises a coupling device for coupling the brush carrier to the adjusting device, the brush carrier being pivotable relative to the holding arm in dependence upon a change in length of the adjustment member for pivoting the disc brush about a pivot axis aligned at a slant to the axis of rotation.

In the sweeping vehicle in accordance with the invention, the disc brush is held directly on the holding arm. For this purpose, the holding device comprises a brush carrier on which the disc brush is held and which, in turn, is pivotably connected to the holding arm and thereby pivotable relative to the holding arm. By acting on the brush carrier, it can be pivoted relative to the holding arm and, consequently, the disc brush pivoted relative to the sweeping vehicle. Furthermore, the sweeping vehicle in accordance with the invention comprises a coupling device for coupling the adjusting device to the brush carrier. By means of the coupling device, a change in length of the adjustment member can be detected and the brush carrier can be acted upon in such a way that it is pivotable relative to the holding arm and, consequently, the disc brush is pivotable about a pivot axis aligned at a slant to the axis of rotation. The slanting alignment of the pivot axis relative to the axis of rotation brings about a change in the inclination of the brush disc relative to the horizontal and to the ground surface and, consequently, a change in the sweeping pattern. The possibility of changing the sweeping pattern is advantageous for changing the direction in which dirt is swept off the ground surface. For example, the sweeping pattern can be changed in dependence upon a direction of travel of the sweeping vehicle, in order to improve the cleaning result. Since the adjustment member can be used to pivot the brush carrier and the disc brush, in the sweeping vehicle in accordance with the invention it is not necessary to provide a further adjusting device by means of which the sweeping pattern is changed. Instead, in contrast to a conventional sweeping vehicle, the sweeping vehicle in accordance with the invention, with a constructional simplification, manages with only one adjustment member for lifting and lowering the disc brush and for pivoting it in order to change the sweeping pattern.

The pivot axis and the axis of rotation may be aligned in a skew manner in relation to each other and need not intersect in order for the change in the inclination of the brush disc to be possible.

In an advantageous embodiment of the sweeping vehicle in accordance with the invention, it is expedient for the coupling device to comprise an elastic element which acts between the brush carrier and the holding arm and counter to the action of which the brush carrier is pivotable relative to the holding arm. Owing to a change in length of the adjustment member, for example, in a first direction, the brush carrier can be pivoted relative to the holding arm in a first pivoting direction counter to the action of the elastic element. Owing to a change in length of the adjustment member in the opposite second direction, the pivoting of the brush carrier relative to the holding arm takes place in an opposite second pivoting direction under the action of the elastic element. The elastic element makes it possible, for example, to reduce or even completely eliminate the load acting on the adjustment member for pivoting the brush carrier in the second pivoting direction. The elastic element is, in particular, a spring, for example, a leg spring or a helical spring.

The brush carrier can be coupled to the adjustment member by the coupling device in various ways. For example, the brush carrier may be directly or indirectly connected to the adjustment member. A change in length of the adjustment member can thereby be directly or indirectly transmitted to the brush carrier to pivot it relative to the holding arm.

In a different advantageous embodiment, it has proven expedient for the coupling device to comprise a first coupling stop element which is in operative connection with the brush carrier and interacts with a second coupling stop element in operative connection with the adjustment member for pivoting the brush carrier relative to the holding arm in dependence upon a change in length of the adjustment member. Owing to a change in length of the adjustment member, the second coupling stop element associated with it can be moved. The coupling stop elements may act as actuator stops so that when the second coupling stop element strikes the first coupling stop element associated with the brush carrier, the brush carrier can be acted upon and it can be pivoted relative to the holding arm. To pivot the brush carrier relative to the holding arm in the opposite pivoting direction, the sweeping vehicle preferably comprises the above-mentioned elastic element. It may, however, also be provided that further coupling stop elements are in operative connection in each case with the brush carrier and the adjustment member and, upon a change in length of the adjustment member in the opposite direction, can interact to pivot the brush carrier in the opposite pivoting direction.

In a constructionally simple design of the sweeping vehicle, it may be provided that the first coupling stop element is arranged directly on the brush carrier and/or is comprised by it and/or the second coupling stop element is arranged directly on the adjustment member and/or is comprised by it.

In a further advantageous embodiment of the sweeping vehicle in accordance with the invention, it may be provided that the coupling device comprises a coupling lever which is pivotably connected to the brush carrier and which comprises the coupling stop element. Use of the coupling lever makes a more compact and more robust construction of the brush carrier possible.

In a different advantageous embodiment of the sweeping vehicle, it is provided that the coupling device comprises a first coupling lever which is pivotably connected to the brush carrier, and a second coupling lever which is pivotably connected to the first coupling lever and pivotably connected to the holding device, and that the first or the second coupling lever comprises the first coupling stop element. The provision of two coupling levers makes a robust construction and a reliable functioning of the coupling device possible. One of the coupling levers, for example, the second coupling lever, comprises the first coupling stop element. With a change in length of the adjustment member, the coupling stop elements can interact in order to move the first coupling stop element with the second coupling stop element. This movement is transmitted via the first coupling lever to the brush carrier in order to pivot the brush carrier relative to the holding arm. For a constructionally simple design of the coupling device, it is expedient for the second coupling lever to be articulated at a joint which connects the holding part and the holding arm in an articulated manner. This makes it possible to save a further joint.

It is advantageous for the adjusting device to comprise an adjusting lever which is pivotably connected to the adjustment member and is pivotably connected to the holding device.

The adjusting lever preferably comprises the second coupling stop element.

To achieve a simple construction of the adjusting device, the adjusting lever is expediently connected to the holding device at a joint at which the holding arm is articulately connected to the holding part. As in the case of the above-mentioned second coupling lever, a joint can thereby be saved. A change in length of the adjustment member results in a movement of the adjusting lever and the second coupling stop element arranged thereon, in order to bring about, in interaction with the first coupling stop element, a pivoting of the brush carrier relative to the holding arm.

The adjusting device preferably comprises a first adjusting stop element which is arranged on the adjusting lever and interacts with a second adjusting stop element arranged on the holding part for pivoting the holding arm relative to the holding part in dependence upon a change in length of the adjustment member. On the one hand, the adjustment member engages the holding arm and, on the other hand, is articulately connected to the adjusting lever which, in turn, is articulately connected to the holding device, in particular, to a joint formed between the holding arm and the holding part. Owing to a change in length of the adjustment member, the angle between the adjustment member and the adjusting lever can be changed until the adjusting stop elements of the adjusting lever and the holding part abut against each other. The adjusting lever can thereby be supported on the holding part. At the same time, the adjustment member connected to the adjusting lever can, therefore, be supported relative to the holding arm. With a further change in length of the adjustment member, the holding arm can thereby be pivoted relative to the holding part. This allows the disc brush to be lifted or lowered.

In the lowered state of the disc brush, the adjusting stop elements are preferably spaced from each other. This enables ground unevennesses to be detected by the disc brush and transferred by way of the brush carrier to the holding arm which can be pivoted relative to the holding part without this pivoting being blocked by the adjusting stop elements.

It is expedient for the holding device to form a joint parallelogram with a first joint member formed by the holding part and three joint members formed by the holding arm. The holding part forms a first joint member which is articulately connected, in each case, to two further joint members formed by the holding arm and located parallel and opposite to each other. The holding arm also forms a third joint member which is articulately connected, in each case, to the two joint members running parallel to each other and extends parallel to the holding part. The joint parallelogram makes it possible in a constructionally simple way for the spacing of the brush disc relative to the ground surface to be changed, with the position of the disc brush relative to the ground surface being maintained. For example, a "floating" mounting of the disc brush can thereby be effected, with which ground unevennesses are automatically compensated. When the holding arm is pivoted relative to the holding part, the joint parallelogram undergoes a change in shape, with the two joint members of the holding arm connected to the holding part simultaneously being pivoted.

The brush carrier is preferably pivotably connected to the holding arm at a joint connecting two joint members to each other, for example, at two joint members formed by the holding arm. This makes it possible to save a joint and allows a constructionally simpler retention of the brush carrier on the holding arm.

It is advantageous for the joint parallelogram to define a vertical plane so that the position of the brush disc relative to the remaining sweeping vehicle does not change when the disc brush is lifted and lowered.

The axis about which the brush carrier is pivotable relative to the holding arm and/or the pivot axis of the disc brush is/are preferably aligned horizontally. This can be achieved in a constructionally simple way in the advantageous embodiment last mentioned. In this case, the axis and/or the pivot axis of the disc brush is/are aligned perpendicularly to the plane defined by the joint parallelogram.

It is expedient for the adjustment member to be arranged between the joint members of the joint parallelogram. The joint members formed by the holding part and the holding arm form, so to speak, a frame which surrounds the adjustment member. On the one hand, this makes a compact construction of the holding device and the adjusting device of the sweeping vehicle possible. At the same time, the adjustment member is protected by the joint members.

Preferably, the pivot axis is not aligned orthogonally to the axis of rotation, i.e., it is aligned at an angle other than 90° to the axis of rotation. In the case of skew axis of rotation and pivot axis, this is to be understood as meaning that an axis parallel to the axis of rotation and intersecting the pivot axis does not intersect it at an angle of 90°. This embodiment offers the advantage that when the disc brush is pivoted, the sweeping pattern unrolls on the ground surface in the circumferential direction of the ends of the brushes that face the ground surface. In this way, the sweeping pattern can be continuously unrolled on the ground surface, for example, by continuous change in length of the adjustment member and associated pivoting of the brush carrier. This allows the direction in which dirt is swept off the ground surface to be continuously changed, for example, in dependence upon the steering angle of a steering of the sweeping vehicle.

It was mentioned at the outset that in order to achieve a defined sweeping direction with the disc brush, the brush disc may be aligned at a slant to the horizontal and the axis of rotation at a slant to the ground surface.

It is expedient for the axis of rotation to be aligned at a slant to the ground surface independently of the length of the adjustment member. This allows saving of an adjusting device for adjusting the axis of rotation from a direction aligned perpendicularly to the ground surface to a direction aligned at a slant to the ground surface. This simplifies the constructional design of the sweeping vehicle.

The pivot axis advantageously extends through or substantially through the center point of the brush disc. This allows the inclination of the brush disc relative to the ground surface to be changed, with the position of the brush disc relative to the remaining sweeping vehicle being stationary. The space required for changing the sweeping pattern is thereby minimized.

It was previously mentioned that the disc brush can be pivoted in dependence upon the steering angle. It is expedient for the adjusting device to comprise a steering angle detection element in operative connection with the adjustment member for detecting the steering angle of a steering of the sweeping vehicle and for the length of the adjustment member to be adjustable in dependence upon the steering angle of the steering. This makes it possible, when the sweeping vehicle is being driven around a bend, to set the length of the adjustment member and, under the action of the coupling device, to pivot the disc brush such that the direction in which dirt is swept off the ground surface faces a dirt pick-up device of the sweeping vehicle. With different directions of travel, in particular, when driving around a bend, a best possible sweeping result can thereby be achieved.

The steering angle detection element may, for example be configured as rotary encoder, for example, as potentiometer or Hall sensor. The steering angle detection element can be coupled stepwise to the steering by one or more switches, for example, microswitches. It may also be provided that the adjusting device comprises a positive guide for the steering angle detection element, which is adjustable in dependence upon the steering angle of the steering, and on the basis of the position of which the steering angle detection element detects the steering angle of the steering. When the steering of the sweeping vehicle is actuated, this results in an adjustment of the positive guide, for example, a connecting link guide, which, in turn, can be detected by the steering angle detection element.

The coupling of the adjustment member to the steering angle detection element is, for example, mechanical, for example, by way of a Bowden cable. An electrical coupling of the steering angle detection element and the adjustment member is also conceivable, for example, if the adjustment member comprises a threaded spindle which is drivable by a motor.

In a different embodiment of the sweeping vehicle, it may be provided that the steering angle detection element and the adjustment member are, in each case, piston-cylinder units of a hydraulic or a pneumatic system, in particular, a closed system. For example, the steering angle detection element and the adjustment member are transmitting piston-cylinder units and receiving piston-cylinder units, respectively, which are connected by a hydraulic line, and the lengths of which are reciprocally changeable.

As mentioned, it is known for the dirt swept off the ground surface with the disc brush to be picked up by a dirt pick-up device. The dirt pick-up device is usually arranged in the direction of travel behind the disc brush, preferably in a rear area of the sweeping vehicle.

It is advantageous for the brush disc to be inclinable in the direction of a vehicle center of the sweeping vehicle when the sweeping vehicle is being driven around a bend. When driving around a bend, it is possible, in the manner explained hereinabove, for the length of the adjustment member to be changed and, under the action of the coupling device, for the brush disc to be pivoted. In particular, if the steering is turned, the pivoting of the brush disc can be effected in a way in which the sweeping vehicle drives around a bend in a direction opposite to the arrangement of the disc brush at the side of the sweeping vehicle. For example, if the disc brush is a right disc brush, the brush disc can thus be inclined from the right in the direction of the vehicle center when the sweeping vehicle is in a left bend. This results in the sweeping pattern being displaced in the direction of the vehicle center. When driving around a left bend, this allows areas of the ground surface, which without a change in the inclination of the brush disc in the direction of the vehicle center would remain uncleaned, to be swept with the right disc brush. In sweeping vehicles in which the dirt pick-up device is a sweeping roller arranged behind and at a distance from the disc brush at the side, the so-called "dirt crescent", an uncleaned crescent-shaped area of the ground surface when driving around a left bend, can thereby be reduced. In a corresponding manner, when driving around a right bend, the brush disc of a left disc brush can be inclined in the direction of the vehicle center, so that its sweeping pattern can be displaced from the left in the direction of the vehicle center.

It is expedient for the sweeping vehicle to comprise in the longitudinal direction of the vehicle an auxiliary disc brush arranged behind the disc brush, and a dirt pick-up device arranged behind the auxiliary disc brush, the auxiliary disc brush being liftable off the ground surface when the sweeping vehicle is being driven straight ahead and lowerable onto the ground surface when the sweeping vehicle is being driven around a bend. In connection with the embodiment of the sweeping vehicle last described, it was mentioned that when driving around a bend, the so-called "dirt crescent" can be reduced by inclining the brush disc in the direction of the vehicle center. In the present embodiment, using the auxiliary disc brush arranged between the disc brush and the dirt pick-up device, it is possible to even completely remove the dirt crescent by the auxiliary disc brush being lowered when driving around a bend. For, when driving around a bend, dirt that remains in the area of the dirt crescent when the disc brush is used on its own can be swept up by the auxiliary disc brush or swept towards the dirt pick-up device, for example, a sweeping roller. For this purpose, the brush disc of the auxiliary disc brush is preferably inclined in the direction of the vehicle center. The auxiliary disc brush is, however, not required when the sweeping vehicle is being driven straight ahead. In order to avoid unnecessary wear of the brushes, they can be lifted off the ground surface.

It was just mentioned that the sweeping vehicle may comprise a right and a left disc brush. In particular, it is expedient for the sweeping vehicle to comprise two disc brushes which are configured symmetrically in relation to each other and are arranged at mutually opposite sides on the sweeping vehicle. The two disc brushes configured symmetrically in relation to each other are preferably a left and a right disc brush of the sweeping vehicle, and, like the disc brush of one of the sweeping vehicles described hereinabove, they are each held by the holding device on the sweeping vehicle and are pivotable by means of the adjusting device and under the action of the coupling device relative to the sweeping vehicle. Where references are made, in the present case, to the disc brush, the holding device, the adjusting device and the coupling device and to their respective components or features, this is to be understood as reference to at least one disc brush, at least one holding device, at least one adjusting device and at least one coupling device, respectively.

In order to achieve a compact construction, a drive motor for the disc brush is preferably held on the brush carrier.

It is expedient for the holding part to be mounted on a frame of the sweeping vehicle for pivotal movement about a vertical axis, in particular, counter to the action of a reset element. This makes it possible in the event of a collision of the sweeping vehicle with an obstacle for the holding device to be pivoted relative to the frame, in order to avoid damage to the holding device, the adjusting device, the coupling device, and/or the disc brush. Under the action of the reset element, the holding part can automatically return to the initial position.

A preferred embodiment of a sweeping vehicle in accordance with the invention is designed as so-called "ride-on sweeper", illustrated perspectively in FIG. 1 and denoted therein in its entirety by reference numeral 10. The sweeping vehicle 10 serves to clean a ground surface 11 indicated in FIGS. 5 to 7 and for this purpose can be moved by means of an undercarriage 12 over the ground surface 11. The undercarriage 12 comprises two wheels 16 and 17 rotatable about a common axis at a rear side of the sweeping vehicle 10. For steering and driving purposes, the sweeping vehicle 10 has a rotationally drivable steering roller 20 arranged in the region of its vehicle center plane 19 near its front side 18. An operator can act on the steering roller 20 by means of a steering 22 comprising a steering wheel 21.

The sweeping vehicle 10 comprises a plurality of sweeping units for picking up dirt from the ground surface 11 to be cleaned. A dirt pick-up device 25 in the form of a sweeping roller 24 is mounted for rotation about an axis of rotation aligned parallel to the axis of rotation of the wheels 16 and 17 near the rear side 14. At the front side 18, the sweeping vehicle 10 comprises a right disc brush 26 and a left disc brush 28, and arranged between the right disc brush 26 and the sweeping roller 24 on the right side of the sweeping vehicle 10 is an auxiliary disc brush 30. By means of the sweeping roller 24 and the disc brushes 26, 28 and 30, sweepings can be swept up from the ground surface 11 and transferred to a dirt container 32 arranged at the rear side 14.

Figure 2:
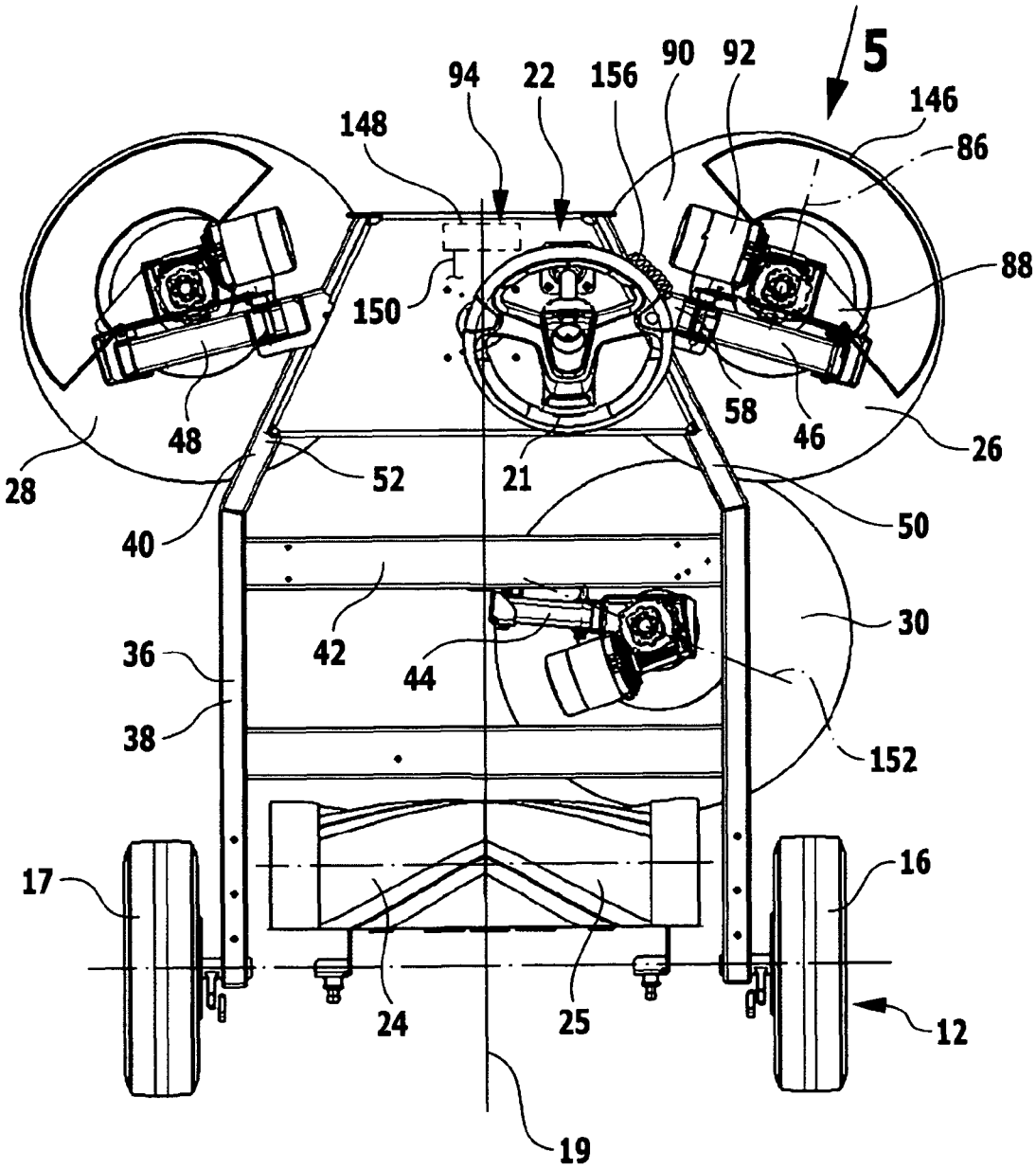
FIG. 2 shows a plan view of a chassis of the sweeping vehicle from FIG. 1 when driving straight ahead.
Figure 3:
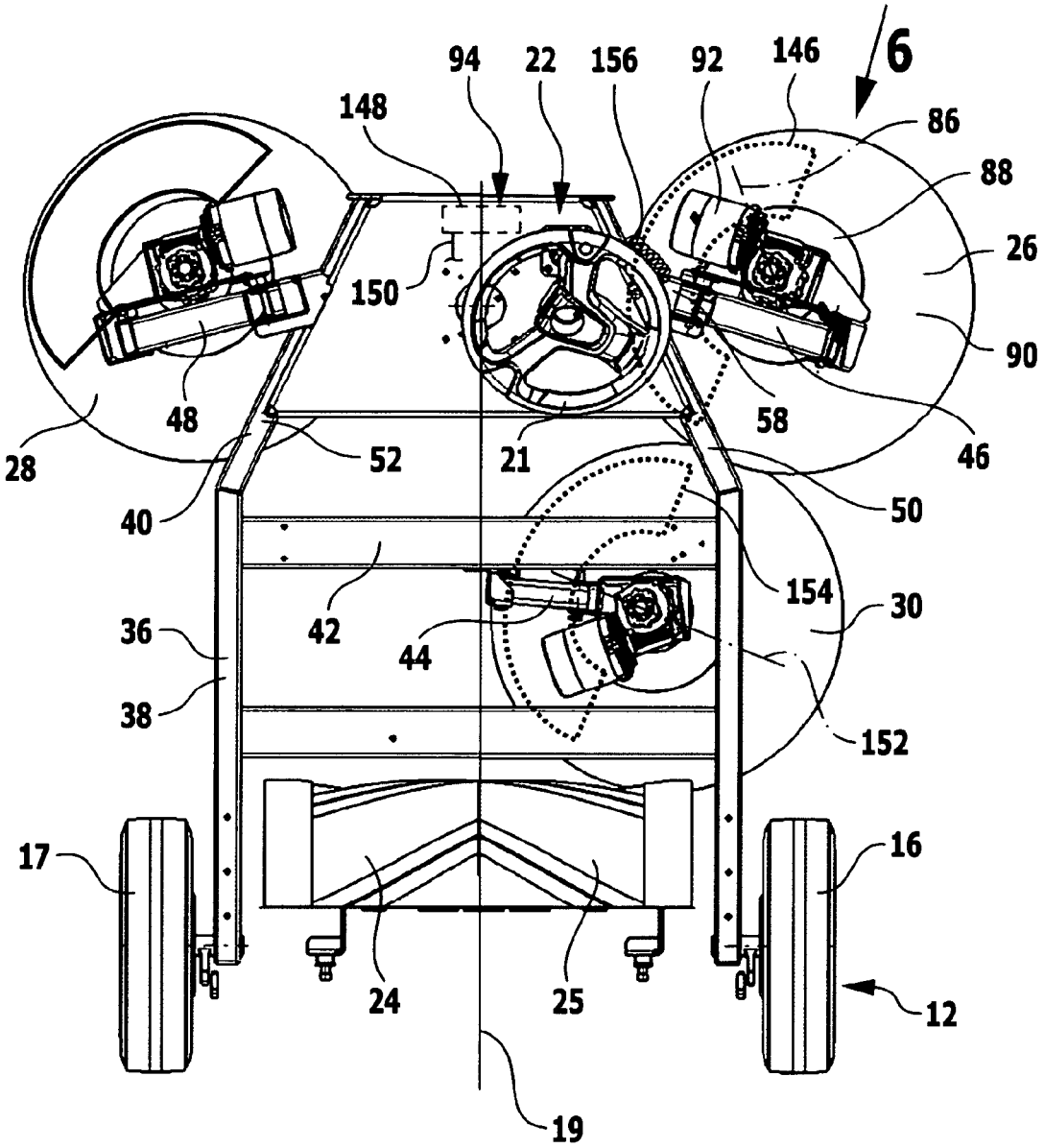
FIG. 3 shows a representation corresponding to FIG. 2 when the sweeping vehicle is being driven around a left bend.

The sweeping units and the undercarriage 12 as well as the remaining components of the sweeping vehicle 10, for example, a structure 34, are held on a chassis 36 of the sweeping vehicle 10 shown in a plan view in FIGS. 2 and 3. The chassis 36 comprises a rear rectangular section 38 and a front trapezoidal section 40. A holding device, not shown in the drawings, serves to hold the sweeping roller 24 on the rectangular section 38. The auxiliary disc brush 30 is held on a cross member 42 of the section 38 so as to be liftable and lowerable by means of a combined holding and lifting device 44. The disc brushes 26 and 28 are held by means of holding devices 46 and 48, respectively, on a right support 50 and a left support 52, respectively, of the trapezoidal section 40, the supports 50 and 52 forming the non-parallel sides of the section 40.

The disc brushes 26 and 28 and the holding devices 46 and 48 are configured symmetrically relative to each other in relation to the vehicle center plane 19. Therefore, only details of the right disc brush 26 and the right holding device 46 will be gone into hereinbelow.

Figure 4:
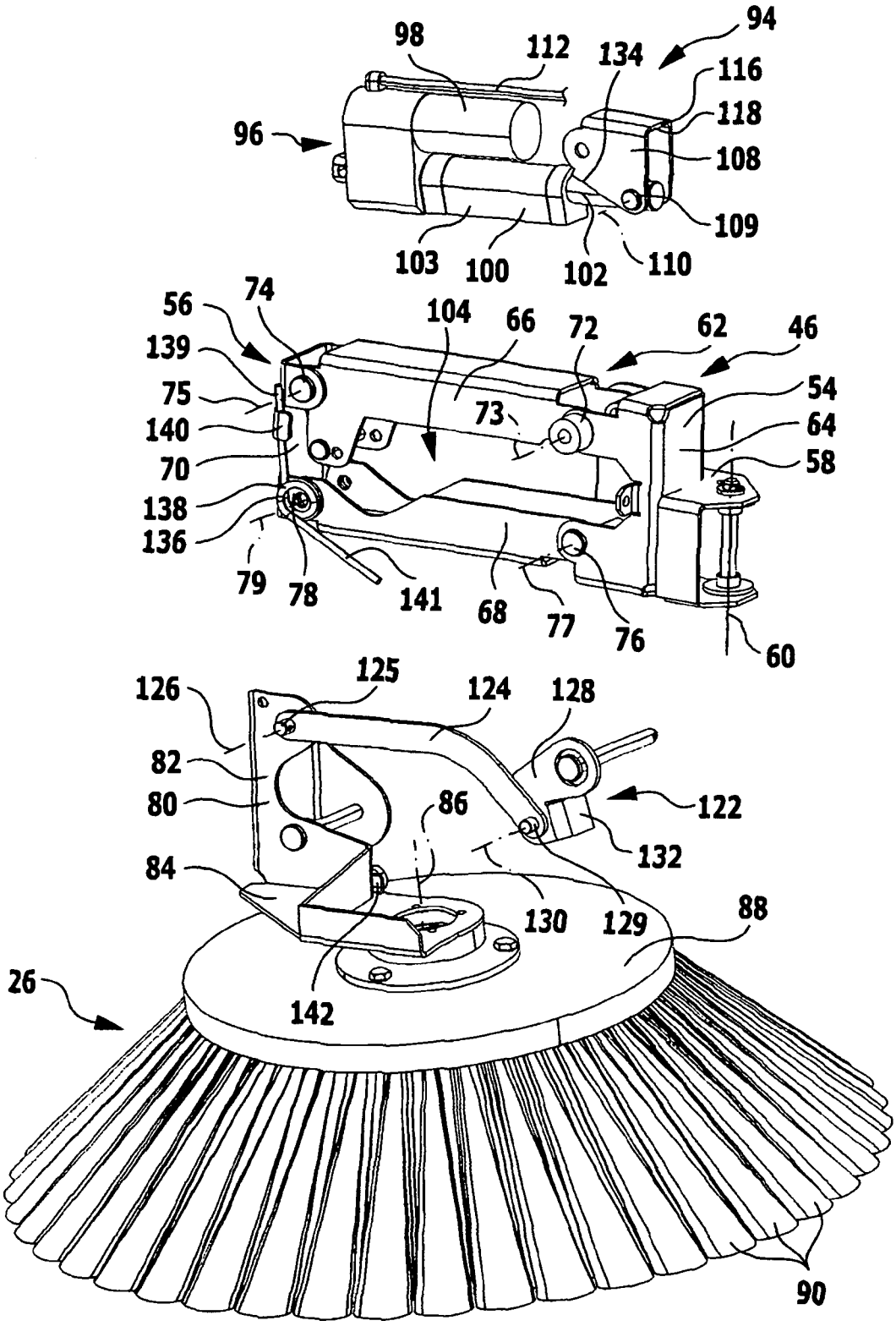
FIG. 4 shows a perspective view of a disc brush, a holding device, an adjusting device and a coupling device of the sweeping vehicle from FIG. 1, partly in exploded representation.

As will be clear, in particular, from FIGS. 4 to 7 and especially FIG. 4, the holding device 46 comprises a holding part 54 and a multipart holding arm 56 pivotable relative to the holding part 54. The holding part 54 serves to secure the holding device 46 to the chassis 36 and, in particular, to the support 50. For this purpose, the holding part 54 comprises a holding projection 58, which engages over and under the support 50 and is connected to the support 50 for pivotal movement about a vertical pivot axis 60.

In the present case, indications of location, direction and position such as, for example, "at the top", "at the bottom", "horizontal", "vertical" and the like are to be understood in relation to a position of use of the sweeping vehicle 10, in which it is positioned on the horizontally aligned ground surface 11.

The holding part 54 and the holding arm 56 form in combination with each other a joint parallelogram 62 with a total of four joint members, the first joint member 64 of which is formed by the holding part 54. The holding arm 56 forms three joint members 66, 68 and 70. The joint members 66 and 68 are longitudinal sides of the joint parallelogram 62, which extend parallel to each other and are articulatedly connected to the first joint member 64. A further joint member 70, which is formed by the holding arm 56, is aligned parallel to the first joint member 64 and articulately connected to the two other joint members 66 and 68 of the holding arm 56.

The joint member 66 is the uppermost of the joint members of the joint parallelogram 62, and it is connected at a joint 72 to the holding part 54 for pivotal movement about a first pivot axis 73. At its opposite side, the joint member 66 is connected at a joint 74 to the joint member 70 for pivotal movement about a second pivot axis 75. The joint member 68 is arranged below the joint member 66 and connected at a joint 76 to the holding part 54 for pivotal movement about a third pivot axis 77. At its opposite side, the joint member 68 is connected at a joint 78 to the joint member 70 for pivotal movement about a fourth pivot axis 79.

The pivot axes 73, 75, 77 and 79 are each defined by bearing bolts, not denoted by separate reference numerals, which hold the joint members 64, 66, 68 and 70 together.

All four joint members 64 to 70 lie in a common, vertical plane, relative to which the pivot axes 73, 75, 77 and 79 are perpendicularly aligned, i.e., these each extend horizontally. The joint parallelogram 62 can be pivoted in the vertical plane so that the holding arm 56 can be pivoted relative to the holding part 54, thereby undergoing deformation, more specifically, to the same extent about the pivot axes 73 and 77.

The holding device 46 further comprises a brush carrier 80. The brush carrier 80 is pivotably connected at the joint 78 to the holding arm 56 and thereby pivotable relative to the holding arm 56 about the fourth pivot axis 79. The brush carrier 80 comprises a holding section 82, which is arranged on the side of the joint member 70 that faces away from the joint members 66 and 68, and by way of which the brush carrier 80 is mounted on the joint 78. A carrying section 84 protrudes from the holding section 82 in the forward direction of the sweeping vehicle 10. The carrying section 84 is aligned at a slant in relation to the plane which is defined by the joint parallelogram 62 and in which the holding section 82 is also arranged, and hence at a slant in relation to a horizontal plane. Furthermore, the carrying section 84 is of planar configuration and has a surface normal at a slant to the ground surface 11 and hence at a slant to the plane defined by the joint parallelogram 62.

Figure 5:
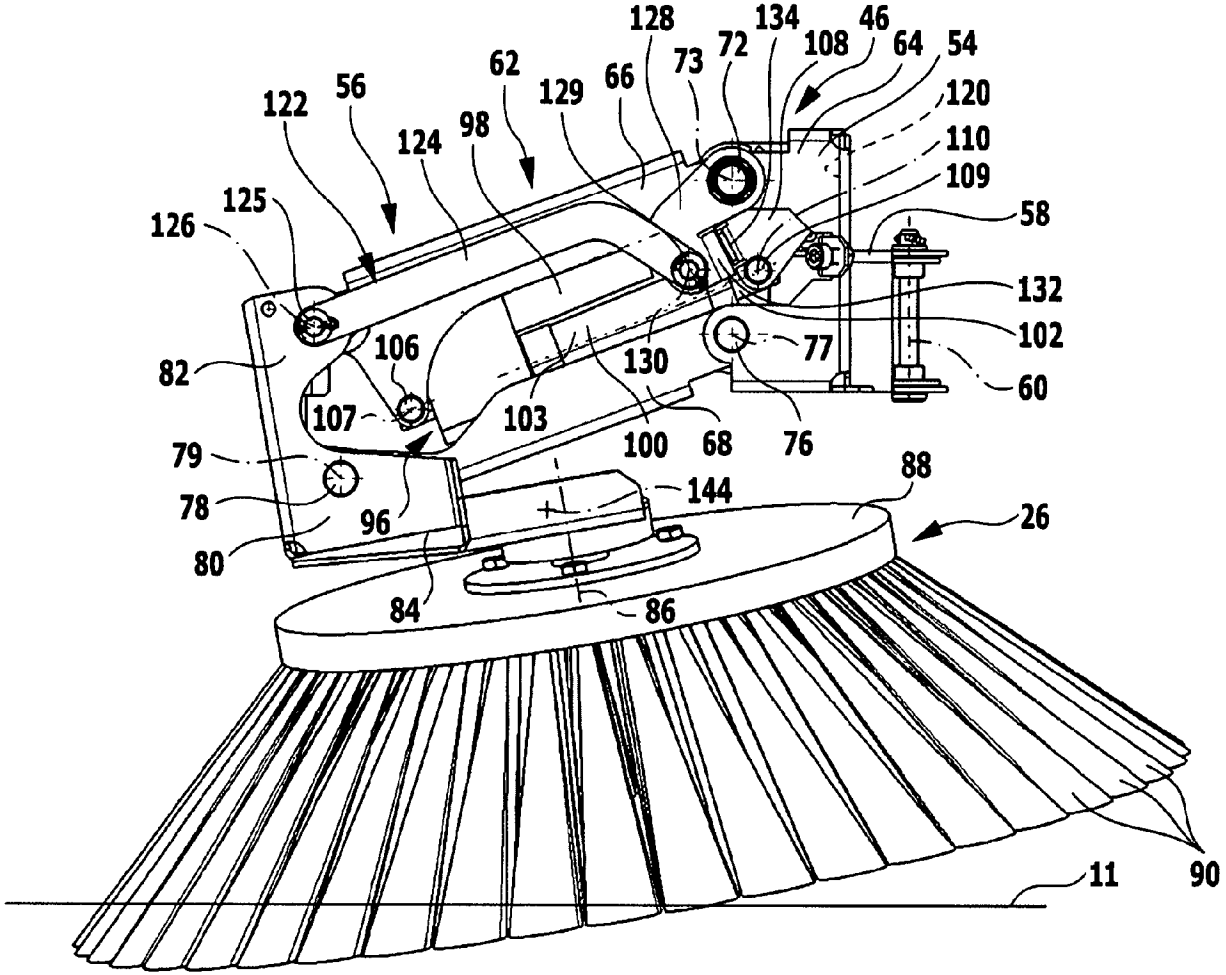
FIG. 5 shows a view in the direction of arrow "5" in FIG. 2, which shows a disc brush of the sweeping vehicle lowered onto the ground surface.
Figure 6:
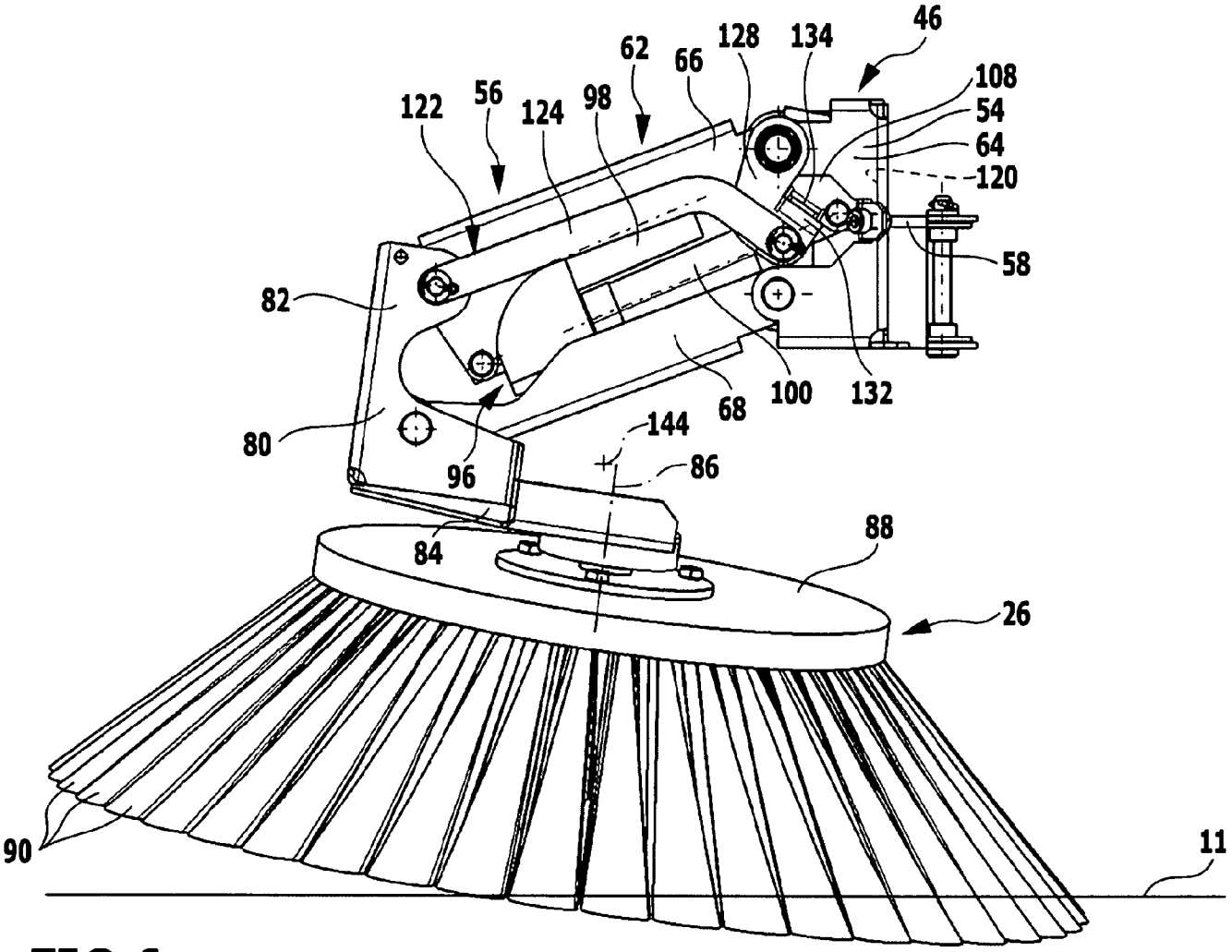
FIG. 6 shows a view in the direction of arrow "6" in FIG. 3 with disc brush lowered onto the ground surface and inclined relative to the position shown in FIG. 5.

The disc brush 26 is rotatably held on the carrying section 84, and its axis of rotation 86 is aligned parallel to the surface normal of the carrying section 84 and at a slant to the ground surface 11. This means that a brush disc 88 of the disc brush 26 arranged below the carrying section 84 runs parallel to the carrying section 84 and is inclined in relation to a horizontal plane. Brushes 90 of the disc brush 26 extend from the brush disc 88 in the direction of the ground surface 11. The approximate position of the lowered disc brush 26 relative to the ground surface 11 is shown in FIGS. 5 and 6. Differently from the illustration, the brushes 90 do not penetrate the ground surface 11, but bend over somewhat and lie on the ground surface 11, which is not taken into account in the drawings.

A drive motor 92 (not shown in FIGS. 4 to 7) is held on the upper side of the carrying section 84 for driving the disc brush 26 about the axis of rotation 86.

The sweeping vehicle 10 comprises an adjusting device 94 for lifting the disc brush 26 off the ground surface 11 and lowering the disc brush 26 onto the ground surface 11 and for changing the inclination of the disc brush 26 in relation to a horizontal plane. The adjusting device 94 comprises an adjustment member 96 with a drive motor 98 and a threaded spindle 100 drivable by the drive motor 98. The drive motor 98 and the threaded spindle 100 form a common constructional unit, in which the threaded spindle 100 can be selectively lengthened or shortened under the action of the drive motor 98. For this purpose, a shaft 102 can be driven out of or into a socket 103 of the threaded spindle 100.

The adjustment member 96 is arranged between the joint members 66 and 68 and 64 and 70 in a receiving space 104 enclosed by the joint parallelogram 62. A first end of the adjustment member 96 is held pivotably somewhat at a slant below the joint 74 on the upper joint member 66. For this purpose, the joint member 66 and the adjustment member 96 form a joint 106 which defines a pivot axis 107.

An adjusting lever 108 of the adjusting device 94 is arranged on the side of the adjustment member 96 opposite the joint 106 and connected to the shaft 102 for pivotal movement about a pivot axis 110 at a joint 109. The adjusting lever 108 also engages the joint 72 at which the holding part 54 is connected to the joint member 66 of the holding arm 56 for pivotal movement about the first pivot axis 73. The adjusting lever 108 is, therefore, also pivotable about the first pivot axis 73 relative to the holding part 54 and to the holding arm 56.

By means of a control line 112, the adjustment member 96 can be activated by a user in order to lower the disc brush 26 onto or lift it off the ground surface 11. For this purpose, an operating element 114, with which a user can activate the lifting and the lowering of the disc brush 26, may be provided on an operating unit 113 arranged near the steering wheel 21. The operating element 114 is in operative connection with the adjustment member 96 via the control line 112.

In a lowered state of the disc brush 26 (FIG. 5) when the sweeping vehicle 10 is being driven straight ahead, the adjustment member 96 is shortened to the maximum extent, i.e., the shaft 102 is driven as far as possible into the socket 103. The adjusting lever 108 is of such shape and dimensions that it protrudes approximately at a right angle from the shaft 102 and is arranged below the joint 72 in the receiving space 104. The adjusting lever 108 is then not in contact with the holding part 54 at the inner wall thereof facing away from the holding projection 58 and facing the receiving space 104.

To lift the disc brush 26 off the ground surface 11, the adjustment member 96 is activated via the control line 112 such that the shaft 102 is driven out of the socket 103, i.e., the adjustment member 96 is lengthened. This results in the joint 109 being moved in the direction of the inner wall of the holding part 54 that faces the receiving space 104. At the same time, the adjusting lever 108 is pivoted relative to the shaft 102 about the pivot axis 110 and relative to the holding part 54 about the first pivot axis 73.

Figure 7:
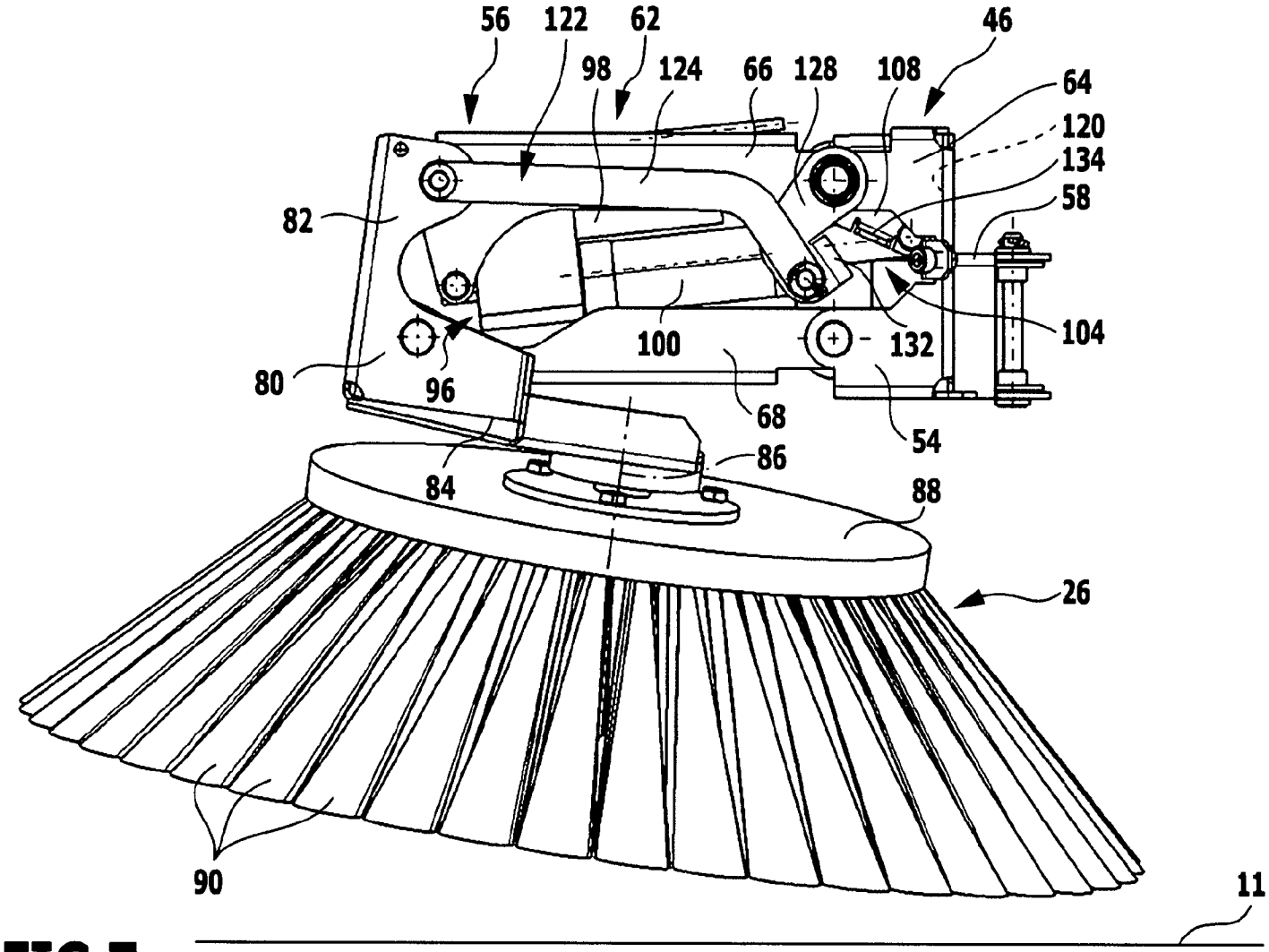
FIG. 7 shows a view corresponding to FIGS. 5 and 6 with disc brush lifted off the ground surface.

From a predetermined length of the adjustment member 96, i.e., when the shaft 102 protrudes from the socket 103 by a predetermined length, the adjusting lever 108 contacts the holding part 54 with an end face 116 facing the holding part 54 (FIG. 4). The end face 116 forms an adjusting stop element 118 of the adjusting device 94. A further adjusting stop element 120 is formed by the inner wall of the holding part 54 that faces the receiving space 104 (FIGS. 5 to 7).

When the adjusting lever 108 strikes the holding part 54, the adjusting stop elements 118 and 120 interact and block further pivoting of the adjusting lever 108 about the first pivot axis 73. This also causes the movement of the shaft 102 in the direction of the holding part 54 to be stopped. Upon further elongation of the adjustment member 96, this results in the joint parallelogram 62 undergoing such deformation that the joint members 66 and 68 are pivoted about the pivot axis 73 and 77 relative to the holding part 54. This causes the brush carrier 80 to be lifted and, consequently, the disc brush 26 to be lifted off the ground surface 11 (FIG. 7).

When the disc brush 26 is conversely lowered onto the ground surface 11, the joint members 66 and 68 are first pivoted relative to the holding part 54, with the joint parallelogram 62 undergoing a change in shape, by the adjustment member 96 being shortened. Due to the force of gravity, the disc brush 26 comes into contact with the ground surface 11, with the adjusting lever 108 being pivoted away from the holding part 54 so the adjusting stop elements 118 and 120 no longer interact.

The sweeping vehicle 10 comprises a coupling device 122 for changing an inclination of the brush disc 88 relative to a horizontal plane under the action of the adjustment member 96. The coupling device 122 comprises a first coupling lever 124. At an upper side of the holding section 82, the first coupling lever 24 is articulated on the brush carrier 80 by means of a joint 125 for pivotal movement about a pivot axis 126. It protrudes from the brush carrier 80 in the direction of the holding part 54 and extends approximately as far as below the joint 72, and it is bent in the direction of the ground surface 11.

At the end opposite the brush carrier 80, the first coupling lever 124 is connected to a second coupling lever 128 of the coupling device 122 for pivotal movement, more particularly, about a pivot axis 130 at a joint 129. The second coupling lever 128 is also of bent configuration and extends in the direction of the upper end of the holding part 54. With its end facing away from the joint 129, the second coupling lever 128 is articulated at the joint 72 so it can also be pivoted about the pivot axis 73. Adjacent to the joint 129, a projection forming a coupling stop element 132 of the coupling device 122 protrudes at a right angle from the second coupling lever 128 into the receiving space 104.

A further coupling stop element 134 is arranged on the adjusting lever 108. The coupling stop element 134 is formed by one of the end faces of the adjusting lever 108, which, when the adjusting lever 108 is aligned at a right angle relative to the shaft 102, are located opposite the socket 103 (FIGS. 4 and 5).

Furthermore, the coupling device 122 comprises an elastic element 136 in the form of a spring 138. The spring 138 is configured as a leg spring with a first leg 139 which engages a holding projection 140 of the joint member 70, and with a second leg 141 which engages a holding projection 142 on the carrying section 84 of the brush carrier 80. The spring 138 pretensions the brush carrier 80 for rotation about the pivot axis 79 relative to the holding arm 56 such that the holding section 82 is pretensioned in the direction towards the joint member 70, and the carrying section 84 in a pivoting direction facing away from the joint member 68, i.e., in clockwise direction in FIGS. 5 to 7. For rotation of the brush carrier 80 in the opposite direction, a force counter to the action of the spring 138 has to be applied, in order to pivot the holding section 82 away from the joint member 70 and the carrying section 84 in the direction of the joint member 68, i.e., in counterclockwise direction in FIGS. 5 to 7.

If, as explained hereinabove, the disc brush 26 is lifted off the ground surface 11 at maximum elongation of the adjustment member 96, the coupling stop elements 132 and 134 are arranged in spaced relation to each other (FIG. 7). Under the action of the spring 138, the holding section 82 lies against the joint member 70. The axis of rotation 86 of the disc brush 26 is aligned at a slant to the ground surface 11 and faces in the direction of the vehicle center plane 19 in the forward direction of the sweeping vehicle 10.

When the disc brush 26 is lowered onto the ground surface 11, the coupling stop elements 132 and 134 enter into contact with each other and can interact. Upon shortening the adjustment member 96, the adjusting lever 108 contacts the projection on the second coupling lever 128. This has the consequence that the coupling lever 128 pivots at the joint 72 about the pivot axis 73, and the coupling levers 124 and 128 pivot relative to each other at the joint 129 about the pivot axis 130.

The movement of the shaft 102 transmitted from the adjusting lever 108 to the second coupling lever 128 is transmitted to the first coupling lever 124 and from the first coupling lever 124 to the brush carrier 80. The brush carrier 80 pivots relative to the coupling lever 124 at the joint 125 about the pivot axis 126 and further relative to the holding aim 56 at the joint 78 about the pivot axis 79.

The disc brush 26 contacts the ground surface 11 as a result of gravity before the coupling stop elements 132 and 134 interact with each other. Therefore, the pivoting of the brush carrier 80 relative to the holding arm 56 occurs when the disc brush 26 has already contacted the ground surface 11. When the brush carrier 80 is pivoted, the disc brush 26 is pivoted relative to the chassis 36, more particularly, about a pivot axis 144, which extends parallel to the pivot axis 79 and like the pivot axis 79 is also aligned horizontally. The pivot axis 144 differs from the pivot axis 79 because the disc brush 26 is supported with the brushes 90 on the ground surface 11 during the pivoting. In FIGS. 5 and 6, the supporting is symbolized schematically by the ground surface 11 intersecting the brushes 90 which, however, actually undergo deformation under the influence of gravity. The pivot axis 144 extends at a slight distance from a center of the brush disc 88 so the disc brush 26 is pivoted almost stationarily in relation to the chassis 36.

The brush carrier 80 is of such shape that when the sweeping vehicle 10 is being driven straight ahead as illustrated in FIGS. 2 and 5, the axis of rotation 86 is inclined in a direction facing away from the vehicle center plane 19 and facing in the direction of travel of the sweeping vehicle 10, i.e., the brush disc 88 is slanted forwards to the right away from the sweeping vehicle 10. This results in the brushes 90 lying on the ground surface 11 along an approximately kidney-shaped or half-ring-shaped area of contact, hereinafter referred to as "sweeping pattern" 146.

Owing to the position of the axis of rotation 86, the sweeping pattern 146 is arranged at a front right-hand corner area of the sweeping vehicle 10 (FIG. 2). As a result, during travel straight ahead, it is also possible for dirt to the right of the base area of the sweeping vehicle 10, for example, when the sweeping vehicle 10 is being moved along a lateral delimitation of the ground surface, to be swept in the direction of the vehicle center plane 19. This dirt can then be swept up by the sweeping roller 24.

The adjusting device 94 comprises a steering angle detection element 148 which is arranged on the steering 22 and is in operative connection via a signal line 150 with the adjustment member 96. Depending upon the steering angle of the steering 22, the adjustment member 96 can be provided with a control signal so that the shaft 102 is driven out of or into the socket 103 under the action of the drive motor 98.

The steering angle detection element 148 is, for example, a rotary encoder, e.g., a potentiometer or a Hall sensor. The steering angle detection element can be coupled to the steering 22 in a stepwise manner, for example, by one or more switches, for example, microswitches. In this way, the steering angle detection element 148 is electrically coupled to the adjustment member 96. A mechanical coupling, a hydraulic or a pneumatic coupling of the adjustment member 96 and the steering angle detection element 148 is also conceivable.

When the sweeping vehicle 10 is being driven around a left bend, the adjustment member 96 is activated so as to cause the shaft 102 to be driven out of the socket 103 and the adjustment member 96 to thereby be lengthened. As a result, the adjusting lever 108 with the coupling stop element 134 deviates in the direction of the holding part 54, as previously explained hereinabove with the example of lifting the disc brush 26. Under the action of the spring 138, the brush carrier 80 is pivoted relative to the holding arm 56. The pivoting angle of the brush carrier 80 is limited by the coupling stop elements 132 and 134 which still interact (FIG. 6).

The disc brush 26 is also pivoted about the pivot axis 144 by the pivoting of the brush carrier 80 about the pivot axis 79. In addition, the holding arm 56 is pivoted upwards somewhat relative to the holding part 54, with the joint parallelogram 62 thereby undergoing deformation, because the disc brush 28 is supported on the ground surface 11 (not taken into account in FIG. 6).

When the disc brush 26 is pivoted, its brush disc 88 is also pivoted about the pivot axis 144 and so the inclination of the brush disc 88 changes in relation to the ground surface 11. In particular, the brush disc 88 is inclined in the direction of the vehicle center plane 19, as is the axis of rotation 86 which is aligned in a slanting and, in particular, skew manner in relation to the pivot axis 144. This has the consequence that the sweeping pattern 146 becomes displaced in the direction of the vehicle center plane 19 (FIG. 3) when the steering wheel 21 is turned to the left. Because the axis of rotation 86 is aligned at a slant to the pivot axis 144, the sweeping pattern 146 unrolls on the ground surface 11 in the direction of the vehicle center plane 19. The displacement of the sweeping pattern 146 when the steering wheel 21 is turned to the left occurs continuously under the action of the spring 138 and the interacting coupling stop elements 132 and 134.

The displacement of the sweeping pattern 146 in the direction of the vehicle center plane 19 when the steering wheel 21 is turned to the left serves to enable dirt between the disc brush 26 and the sweeping roller 24 to be swept in a direction from the ground surface 11 in order that it can be picked up by the sweeping roller 24. For, without displacement of the sweeping pattern 146 when the sweeping vehicle 10 is driven around a left bend, owing to the distance of the disc brush 26 and the sweeping roller 24 from each other, a crescent-shaped area of dirt would otherwise remain on the ground surface 11, the so-called "dirt crescent" (not shown). The size of the dirt crescent can therefore be reduced by the displacement of the sweeping pattern 146 when driving around a left bend.

Since the disc brush 26 and the sweeping roller 24 are spaced at a relatively large distance from each other in the sweeping vehicle 10, it is no longer possible to completely eliminate the dirt crescent with the disc brush 26 alone above a certain steering angle of the steering wheel 21. For this reason, the sweeping vehicle 10 comprises the previously mentioned auxiliary disc brush 30. When the steering wheel 21 is turned to the left, the auxiliary disc brush 30 is lowered onto the ground surface 11 by the combined holding and lifting device 44. Its axis of rotation 152 is inclined in relation to the vehicle center plane 19 and so its sweeping pattern 154 (shown as well as the sweeping pattern 146 in dashed lines in FIG. 3) has a concave shape independently of the steering angle of the steering wheel 21 in relation to the vehicle center plane 19. The sweeping pattern 154 borders substantially on the sweeping pattern of the sweeping roller 24 and so the dirt crescent can be completely eliminated by the auxiliary disc brush 30. Above a certain steering angle of the steering wheel 21, the sweeping patterns 146 and 154 of the disc brushes 26 and 30, respectively, may, for this purpose, even overlap slightly.

When the sweeping vehicle 10 is being driven straight ahead, the auxiliary disc brush 30, as mentioned, is lifted off the ground surface 11, so that it is not unnecessarily worn down.

If the sweeping vehicle 10 is to travel straight ahead again and the steering wheel 21 is turned for this purpose, the adjustment member 96 is activated again via the control line 112 so as to cause the shaft 102 to be driven into the socket 103. As already explained hereinabove, the coupling stop elements 132 and 134 interact in order to pivot the brush carrier 80 relative to the holding arm 56 such that the holding section 82 is pivoted away from the joint member 70. This results in the pivoting of the disc brush 26 about the pivot axis 144 and the displacement of the sweeping pattern 146 to the position shown in FIG. 2.

As the above explanations show, the design of the holding device 46, the adjusting device 94 and the coupling device 122 allows the disc brush 26 to be lowered onto and lifted off the ground surface 11 by means of only one adjustment member 96. In addition, pivoting of the disc brush 26 is possible such that its brush disc 88 can incline in relation to the chassis 36 in dependence upon the steering angle of the steering 22. This allows displacement, as required, of the sweeping pattern 146 for improvement of the cleaning result by reducing the dirt crescent, for the elimination of which the auxiliary disc brush 30 is additionally used.

The formation of the joint parallelogram 62 by the holding part 54 and the holding arm 56 allows a "floating" mounting of the disc brush 26 independently of the steering angle of the steering 22. Unevennesses in the ground surface 11 can thereby be compensated.

The holding device 46 can be pivoted about the vertical pivot axis 60 relative to the frame in order to prevent damage to the disc brush 26 when contacting an obstacle. A reset element 156 in the form of a spiral spring returns the holding device 46 to the initial position (FIGS. 2 and 3).

The above explanations shall apply accordingly to the left disc brush 28. The previously mentioned holding device 48 is provided for holding the left disc brush 28. Furthermore, a coupling device formed symmetrically in relation to the coupling device 122 and an adjusting device formed symmetrically in relation to the adjusting device 94 and also comprising the steering angle detection element 148 for detecting the steering angle of the steering 22 are provided on the disc brush 28.

That which is claimed:

1. A sweeping vehicle, comprising a disc brush for sweeping dirt off a ground surface to be cleaned, the disc brush having a brush disc with brushes held thereon and being rotationally drivable about an axis of rotation, and comprising a holding device for holding the disc brush, the holding device having a holding part and a holding arm pivotably connected to the holding part, the holding device being held on the sweeping vehicle by way of the holding part, and the disc brush being held on the holding arm, and comprising an adjusting device having an adjustment member of variable length, which engages the holding arm, the holding arm being pivotable relative to the holding part in dependence upon a change in length of the adjustment member for lowering and lifting the disc brush, the holding device comprising a brush carrier which is pivotably mounted on the holding arm and on which the disc brush is held, and the sweeping vehicle comprising a coupling device for coupling the brush carrier to the adjusting device, the brush carrier being pivotable relative to the holding arm in dependence upon a change in length of the adjustment member for pivoting the disc brush about a pivot axis aligned at a slant to the axis of rotation.

2. The sweeping vehicle in accordance with claim 1, wherein the coupling device comprises an elastic element which acts between the brush carrier and the holding arm and counter to the action of which the brush carrier is pivotable relative to the holding arm.

3. The sweeping vehicle in accordance with claim 1, wherein the coupling device comprises a first coupling stop element which is in operative connection with the brush carrier and interacts with a second coupling stop element in operative connection with the adjustment member for pivoting the brush carrier relative to the holding arm in dependence upon a change in length of the adjustment member.

4. The sweeping vehicle in accordance with claim 3, wherein the coupling device comprises a first coupling lever which is pivotably connected to the brush carrier, and a second coupling lever which is pivotably connected to the first coupling lever and pivotably connected to the holding device, and the first coupling lever or the second coupling lever comprises the first coupling stop element.

5. The sweeping vehicle in accordance with claim 4, wherein the second coupling lever is pivotably connected to the holding device at a joint at which the holding part is articulately connected to the holding part.

6. The sweeping vehicle in accordance with claim 1, wherein the adjusting device comprises an adjusting lever which is pivotably connected to the adjustment member and is pivotably connected to the holding device.

7. The sweeping vehicle in accordance with claim 6, wherein the adjusting lever comprises the second coupling stop element.

8. The sweeping vehicle in accordance with claim 6, wherein the adjusting lever is pivotably connected to the holding device at a joint at which the holding arm is articulately connected to the holding part.

9. The sweeping vehicle in accordance with claim 6, wherein the adjusting device comprises a first adjusting stop element which is arranged on the adjusting lever and interacts with a second adjusting stop element arranged on the holding part for pivoting the holding arm relative to the holding part in dependence upon a change in length of the adjustment member.

10. The sweeping vehicle in accordance with claim 9, wherein, in a lowered state of the disc brush, the adjusting stop elements are spaced from each other.

11. The sweeping vehicle in accordance with claim 1, wherein the holding device forms a joint parallelogram with a first joint member formed by the holding part and three joint members formed by the holding arm.

12. The sweeping vehicle in accordance with claim 11, wherein the brush carrier is pivotably connected to the holding arm at a joint connecting two joint members to each other.

13. The sweeping vehicle in accordance with claim 11, wherein the joint parallelogram defines a vertical plane.

14. The sweeping vehicle in accordance with claim 11, wherein the adjustment member is arranged between the joint members of the joint parallelogram.

15. The sweeping vehicle in accordance with claim 11, wherein at least one of an axis about which the brush carrier is pivotable relative to the holding arm and the pivot axis is aligned horizontally.

16. The sweeping vehicle in accordance with claim 1, wherein the axis of rotation is aligned at a slant to the ground surface independently of the length of the adjustment member.

17. The sweeping vehicle in accordance with claim 1, wherein the adjusting device comprises a steering angle detection element in operative connection with the adjustment member for detecting the steering angle of a steering of the sweeping vehicle, and the length of the adjustment member is adjustable in dependence upon the steering angle of the steering.

18. The sweeping vehicle in accordance with claim 1, wherein the brush disc is inclinable in the direction of a vehicle center of the sweeping vehicle when the sweeping vehicle is being driven around a bend.

19. The sweeping vehicle in accordance with claim 1, wherein the sweeping vehicle comprises in the longitudinal direction of the vehicle an auxiliary disc brush arranged behind the disc brush, and a dirt pick-up device arranged behind the auxiliary disc brush, the auxiliary disc brush being liftable off the ground surface when the sweeping vehicle is being driven straight ahead and lowerable onto the ground surface when the sweeping vehicle is being driven around a bend.

20. The sweeping vehicle in accordance with claim 1, wherein the sweeping vehicle comprises two disc brushes configured symmetrically in relation to each other and arranged at mutually opposite sides on the sweeping vehicle.

21. The sweeping vehicle in accordance with claim 1, wherein a drive motor for the disc brush is held on the brush carrier.

22. The sweeping vehicle in accordance with claim 1, wherein the holding part is mounted on a frame of the sweeping vehicle for pivotal movement about a vertical axis.

* * * * *